United States Patent [19]

Brown

[11] Patent Number: 5,041,804

[45] Date of Patent: Aug. 20, 1991

[54] PARTICLE FILTER FOR WAVEGUIDES

[76] Inventor: Ian G. Brown, 33 Marmion Dr., Glenrothes, Fife, Scotland

[21] Appl. No.: 555,526

[22] PCT Filed: Jan. 31, 1989

[86] PCT No.: PCT/US89/00389

§ 371 Date: Sep. 5, 1990

§ 102(e) Date: Sep. 5, 1990

[87] PCT Pub. No.: WO89/07346

PCT Pub. Date: Aug. 10, 1989

[30] Foreign Application Priority Data

Feb. 1, 1988 [GB] United Kingdom ..... 8802146

[51] Int. Cl.[5] ..... H01P 1/00

[52] U.S. Cl. ..... 333/248; 333/252

[58] Field of Search ..... 333/230, 252, 248, 99 R

[56] References Cited

U.S. PATENT DOCUMENTS 3,846,798 11/1974 Carl ..... 333/252 X

*Primary Examiner*—Paul Gensler

[57] ABSTRACT

A waveguide is provided which can include a bearing supporting a probe or other equipment for rotation. In order to prevent particles of the waveguide metal or waveguide cleaning materials embedded in the metal from entering the bearing, a window is fitted across the waveguide at a selected position between two waveguide sections or at each of a number of positions, the window being transparent to microwave transmission, being capable of transmitting pressure and being capable of filtering particles of a diameter in excess in 0.005 inch (0.013 cm).

5 Claims, 1 Drawing Sheet

PARTICLE FILTER FOR WAVEGUIDES

This invention relates to waveguides for use in microwave transmission systems and in particular to a waveguide in one wall of which a bearing is mounted for rotatably supporting further equipment such, for example, as a probe or antenna. The invention has particular application to a waveguide in an earth satellite system.

It is known to manufacture waveguides from lengths of rectangular section metal tubing which are slotted or otherwise secured together in end-to-end relationship. Such metallic waveguides are frequently cleaned by a blasting process using glass bead shot. In such a cleaning process, some of the cleaning material may become embedded in the soft metal (for example, copper) of the waveguide and in use, this fine material may work loose and move up or down the waveguide. In a case in which the waveguide contains an accurate bearing such as an air-bearing, these fine particles of shot or of the waveguide material can enter the bearing and cause it to malfunction. There is accordingly a requirement for means to prevent fine particles of material moving along a waveguide. If however, an obstruction is placed across the waveguide, this can interfere with the propagation of the microwaves and also may cause an undesirable build-up of pressure within the waveguide.

According to the present invention, there is provided a waveguide having therein a window extending fully across the interior of the waveguide at a selected location, or at each of a plurality of selected locations, said window being formed of a microporous material capable of transmitting pressure between opposite sides thereof and capable of forming a filter for particles of a diameter in excess of 0.005 inch (0.013 cm).

In particular, the waveguide can include a bearing supporting a probe or other equipment for rotation, the window, or windows, screening the bearing against contamination by particles discharged from said part of the waveguide. Preferably, the window is formed of microporous polytetrafluoroethylene.

One embodiment of a waveguide in accordance with the invention will now be described by way of example with reference to the accompanying drawings in which FIG. 1 is a perspective, exploded, diagrammatic view of a waveguide comprising two waveguide sections and a window fitted between them.

Figures 1, 2, 3:
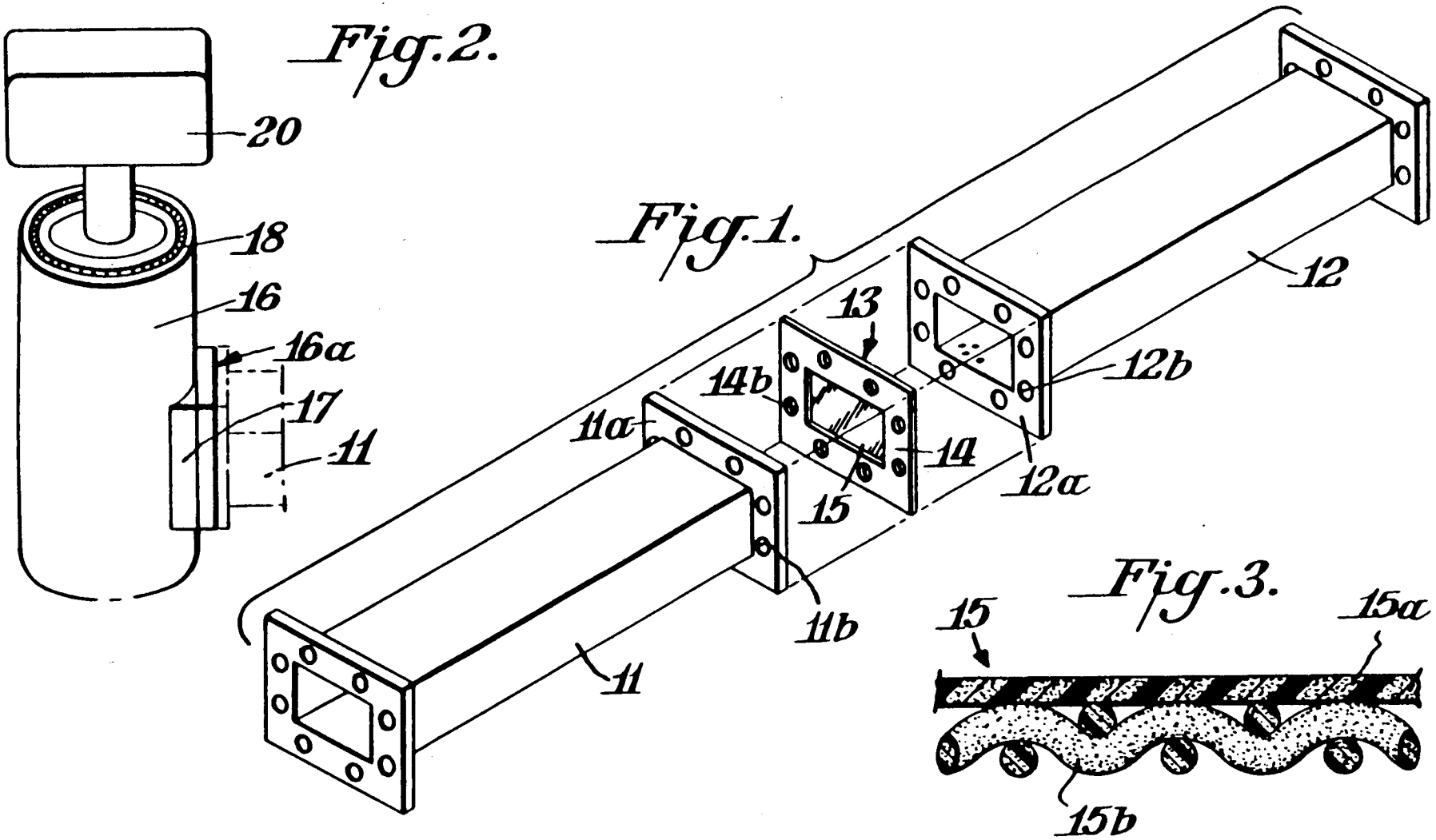
FIG. 2 is a perspective, diagrammatic view of a hollow cylinder to which the waveguide assembly of FIG. 1 can be fitted, the cylinder mounting a bearing at one end in which a probe or other equipment is mounted.
FIG. 3 is a diagrammatic sectional view of material from which the window can be formed.

As shown in FIGS. 1 and 2, the waveguide comprises two metallic waveguide sections 11,12 of hollow rectangular cross-section formed at their adjacent each with flanges 11*a*,12*a* by means of which the sections can be interconnected.

A waveguide window 13, arranged to be fitted and bolted between the two waveguide sections, comprises a metallic hollow rectangular frame 14 across which a sheet of window material 15 extends. The sheet of window material can be adhered to one face of the frame 14 or sandwiched between a pair of frames 14. FIG. 1 shows corresponding bolt holes 11*b*,12*b*,14*b* in the flanges 11*a*,12*a* and the window frame 14 for receiving bolts (not shown) to secure the sections 11,12 and window frame 14 together.

FIG. 2 shows a hollow cylinder 16 having an opening 16*a* in its side wall around which a rectangular coupling frame 17 is secured to which the left hand end (as seen in FIG. 1) of the waveguide section 11 can be coupled by screws. The upper end of the cylinder 16 supports a bearing 18 in which a probe or other equipment indicated by reference 20 is supported for rotation about the axis of the cylinder 16.

The bearing 18, which can be an air bearing, is an accurately formed piece of equipment which could be damaged or caused to malfunction by the ingress of particles in excess of 0.005 inch (0.013 cm) diameter. Accordingly, the window is provided either in the position shown in FIG. 1 or between the waveguide section 11 and the coupling frame 17 to filter out such particles which might otherwise enter the cylinder 16 and the bearing 18.

The window material 15 is preferably 100% expanded polytetrafluoroethylene (PTFE). In the form illustrated in FIG. 3, the window material is seen to be a laminate of which one layer 15*a* is a sheet or membrane of microporous expanded PTFE made preferably by the process described in U.S. Pat. No. 3,953,566. The other layer 15*b* is formed of woven nonporous expanded PTFE, the warp and weft filaments or fibers each being of the same PTFE material, also made in accordance with the above-mentioned patent. The two layers are preferably bonded together either by the application of heat and pressure or by a pattern of adhesive dots. The woven layer will be substantially stronger mechanically than the PTFE sheet and will thus support the sheet and protect it from fracture.

EXAMPLE

An example of the preferred window material has the following characteristics:

| | |
|---|---|
| Woven Backing Material | |
| Fiber diameter: | 0.006 inch (0.015 cm) nominal |
| Thread count: | Warp 36 per inch (14 per cm)<br>Weft 40 per inch (16 per cm) |
| Strength of fiber: | 3.4 grams per denier |
| Membrane Description | |
| Pore Size: | 1.0 micrometers |
| Thickness: | 0.003 inch (0.0076 cm) |
| Porosity: | 91% |
| Mininum Water Entry Pressure: | 10 psi (69 KPa) |

It will be understood that the microporous PTFE membrane will act as a filter for particles in excess 0.005 inch (0.013 cm) diameter but will permit air or other gas to pass through it and so will avoid a build-up of gaseous pressure within the waveguide sections.

Although the preferred material for the window is microporous PTFE, other materials can be used provided that they are transparent to pressure, and capable of acting as a filter for particles in excess of 0.005 inch (0.013 cm).

Although only one window has been referred to herein two or more windows can be used in a waveguide at selected locations.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A waveguide having therein at least one window extending fully across the interior of the waveguide at a selected location, said window being formed of a flexible microporous filtering material which acts as a filter for particles of a diameter in excess of 0.005 inch (0.013 cm).

2. A waveguide according to claim 1 which includes a bearing supporting a probe for rotation, the window screening the bearing against contamination by particles discharged from said waveguide.

3. The waveguide of claim 1 having a plurality of said windows at selected locations.

4. A waveguide according to claim 1 or claim 2 wherein the window is formed of microporous polytetrafluoroethylene (PTFE).

5. A waveguide according to claim 4 wherein the material of the window comprises a laminate of a membrane of microporous expanded PTFE and a woven layer of microporous expanded PTFE filaments.

* * * * *